US005904836A

United States Patent [19]

Lee et al.

[11] Patent Number: 5,904,836

[45] Date of Patent: May 18, 1999

[54] HIGH-VACUUM OIL REFINERY SYSTEM AND PROCESS

[75] Inventors: Dae Sung Lee, B-307 Yangji Apartment, #275 Nonhyun-Dong, Kangnam-Ku; Ho Keun Shin, both of Seoul, Rep. of Korea

[73] Assignee: Dae Sung Lee, Seoul, Rep. of Korea

[21] Appl. No.: 08/595,374

[22] Filed: Feb. 1, 1996

[30] Foreign Application Priority Data

Feb. 3, 1996 [KR] Rep. of Korea ..... 95-1886

[51] Int. Cl.[6] ..... C10G 67/00; C10G 9/14; C10G 17/00; B04B 15/02

[52] U.S. Cl. ..... 208/97; 208/67; 208/100; 208/102; 208/103; 196/46; 196/98; 196/138; 494/14; 494/900; 494/901

[58] Field of Search ..... 208/67, 97, 100, 208/102, 103, 105, 131, 132, 208 R, 340, 193; 494/14, 900, 901; 196/46, 98, 138

[56] References Cited

U.S. PATENT DOCUMENTS

| | | | |
|---|---|---|---|
| 1,676,069 | 7/1928 | Backlund | 494/14 |
| 2,216,683 | 10/1940 | Armistead, Jr. | 196/67 |
| 2,234,916 | 3/1941 | Jones | 494/14 |
| 2,304,070 | 12/1942 | Benedict | 196/49 |

*Primary Examiner*—Glenn Caldarola
*Assistant Examiner*—Thuan D. Dang
*Attorney, Agent, or Firm*—Vidas, Arrett & Steinkraus, P.A.

[57] ABSTRACT

High-vacuum oil refinery systems and process are disclosed in this invention. The systems and process enables to carry out vaporization and distillation of oils under the condition of $1–10^{-4}$ Torr of high vacuum and at the temperature of not higher than 360° C. and thereby removing possibility of thermal cracking while heating to be vaporized and easily produces high quality oil. The vaporized gases are centrifugally separated and liquefied by specific gravity using high-vacuum gas specific gravity centrifugal separators and thereby producing high purity oil of uniform quality. The process also carries out vaporization and distillation of the oil at the temperature of not higher than 360° C. so that the process prevents vaporization of sulfur components of the oil, but simply drains the sulfur components along with the concentrated sludge oil and thereby distilling and desulfurizing the crude or heavy oil at the same time without using expensive conventional desulfurizing process. Especilally the pressure reduced thermal cracking device performs the oil

12 Claims, 6 Drawing Sheets

HIGH-VACUUM OIL REFINERY SYSTEM AND PROCESS

BACKGROUND OF THE INVENTION

1. Field of the Invention

The present invention relates in general to high-vacuum oil refining system and process and, more particularly, to an improvement in such system and process for easily separating the crude oil into light oils and heavy oils using a pressure reduced thermal cracking device and a vacuum gas specific gravity centrifugal separator, and for producing varieties of light oils using the multi-step light oil vapor gas specific gravity vacuum centrifugal separators, and for producing varieties of heavy oils through high-vacuum distillation using high-vacuum creating and sustaining device and vacuum oil recycling and supplying system as well as heavy oil vapor gas specific gravity high vacuum centrifugal separators, and thereby refining and desulfurizing the sulfur contained crude or heavy oil without using expensive desulfurizing process.

2. Description of the Prior Art

Known oil refining processes are generally classified into two-types, the atmospheric pressure distillation and pressure reduced distillation process. In the typical pressure reduced distillation process for oil refining, it has been noted that the desired high-vacuum distillation at $1–10^{-4}$ Torr can not be performed due to inferior technique for generating and keeping the high vacuum.

Therefore, the conventional pressure reduced distillation process has to be performed at a higher temperature than high vacuum distillation. With the high temperature distillation, high heavy oil and super-high heavy oil, both heavy oils having high viscosity, have been distilled in the distillation chamber through vaporization at high temperature ranged from 370° C. to 570° C., being heated beyond the thermal cracking point of the oil. In this regard, the typical pressure reduced process for oil refining has a problem that the process merely produces inferior quality oil and requires large and complicated refining system and thereby increasing the cost and specially causing danger in oil cracking process.

In the case of high viscosity oil obtained through vaporization and distillation at constant temperature and at constant vapor pressure, it is very difficult to produce high purity oil of uniform quality as there is neither device nor technique for centrifugally separating the vaporized gases by specific gravity. In addition, when producing the light oils using typical heavy oil cracking system, the cracking system should use a high temparature, high pressure thermal cracking column having the maximum pressure of 170 kg/cm$^2$ and the maximum temperature of 450° C. Therefore, this cracking system is enlarged in its scale and increased in the system cost and also may cause danger due to the super-high pressure of 170 kg/cm$^2$.

SUMMARY OF THE INVENTION

It is, therefore, an object of the present invention to provide high-vacuum oil refining system and process in which the above problems can be overcome carrying out vaporization and distillation of the crude oil under the condition of high vacuum of $1–10^{-4}$ Torr and the vaporization temperature of not higher than 360° C. and thereby removing possibility of thermal cracking phenomena the oil is being heated and easilly producing high viscosity oil, and centrifugally separate and liquefy the vaporized gases by specific gravity using high-vacuum vapor gas specific gravity centrifugal separators instead of the conventional distillation tower and thereby producing high purity oil of uniform quality using the high-vacuum refining process including vaporization and distillation carried out at relatively low temperature of not higher than 360° C. In this way vaporization of the sulfur components of the oil, which sulfur components are vaporized when the temperature of vaporization is higher than 370° C., is prevented. The sulfur components of the liquid phase are drained along with the sludge in order for additional treatment, and thereby refining and desulfurizing the crude or heavy oil without using expensive desulfurizing unit.

It is another object of the present invention to provide a high-vacuum oil refining system in which an oil pumping pressure is generated when the pressure reduced thermal cracking device is in operation to make an oil flow through the heating pipe of the thermal cracking device, in such a manner that the oil pumping pressure does not cause danger in the oil cracking and in vaporizing process and which system, the oil gas is vaporized, expanded, cooled and accelerated due to suddenly changed vacuum environment and suddenly enlarged diameter of the vacuum pipe, which pipe extends between the end of the heating pipe of the thermal cracking device and the vacuum gas specific gravity centrifugal separator, and in turn introduced into the vacuum gas specific gravity centrifugal separator the moment the oil gas is introduced into the vacuum pipe, so that the danger of explosion is not different from a typical high pressure thermal cracking device. The oil refining system of the invention can produce varieties of light or heavy oils and achieve the recent trend of compactness of the system reducing the cost.

In order to accomplish the above objects the present invention provides a high-vacuum oil refinery system comprising:

- an oil separating unit for separating light oils from heavy oils by a pressure reduced thermal cracking process, said oil separating unit including:
  - an oil/water separating reservoir;
  - a first intermediate terminal connected to said reservoir through both a first pump and an oil filter, said first terminal being provided with a second pump for pumping the crude or the raw oil of the first terminal;
  - a heat exchanger for preheating the oil out of said first terminal, said heat exchanger being connected to said first terminal;
  - a pressure reduced thermal cracking device for thermally cracking the preheated crude or heavy oil, said device being connected to said heat exchanger; and
  - a first, vacuum gas specific gravity centrifugal, separator connected to said thermal cracking device through a vacuum pipe, said first separator centrifugally separating the light oils from the heavy oils by specific gravity;
- a heavy oil production unit connected to said oil separating unit and adapted for separating the heavy oils and producing varieties of heavy oils by classes, said heavy oil production unit including:
  - a second, heavy oil intermediate, terminal connected to said first separator of the oil separating unit and adapted for temporarily keeping the heavy oils out of the first separator, said second terminal having a float valve so that the second terminal is selectively opened when the level of the heavy oils in the second terminal exceeds a predetermined level;
  - second to fourth, high-vacuum gas specific gravity centrifugal, separators for separating the heavy oils by classes, each having a tank associated therewith, said second to fourth separators being orderly connected to the bottom of the second terminal and collecting the varieties of heavy oils, that is, high heavy oil, heavy oil and machine oil, on their bottoms respectively, said oils collected by the second and fourth separators being directly drained to their associated tanks respectively, while said heavy oil collected by the third separator being indirectly drained to its associated tank by way of an oil cooler;

a high-vacuum vaporization desulfurizing device connected to said high heavy oil tank and adapted for desulfurizing the high heavy oil by high vacuum vaporization;

fifth and sixth, high-vacuum gas specific gravity centrifugal, separators orderly connected to said desulfurizing device, each having a tank associated therewith, said fifth and sixth separators being adapted for liquefying vapor gas out of said desulfurizing device into super-high heavy oil and high heavy oil in accordance with degrees of vacuum and liquefying temperatures of the fifth and sixth separators and supplying the super-high heavy oil and the high heavy oil to their associated tanks by way of oil coolers; and first to third condensers connected to each other and adapted for condensing and liquefying the remaining gases that fail to be liquified in said fourth and sixth separators, said first condenser being commonly connected to the fourth separator through both a first gas pipe and a first vacuum pipe and to the sixth separator through both a second gas pipe and a second vacuum pipe, the oils condensed and liquefied by said first to third condensers being kept in their tank, and the bottom of said third condenser being connected to a high-vacuum pump which uses vacuum oil;

a vacuum oil recycling and supplying unit for reproducing the vacuum oil of the high vacuum pump, said vacuum oil recycling and supplying unit being connected to said third condenser of the heavy oil production unit through said high-vacuum pump;

a light oil production unit connected to the top of the first separator and adapted for separating the light oils and producing varieties of light oils by classes, said light oil production unit including:

seventh to ninth, light oil vacuum gas specific gravity centrifugal, separators orderly connected to said first separator of the oil separating unit, each having a tank associated therewith, said seventh to ninth separators being adapted for liquefying and collecting said varieties of light oils, that is, light oil, gas oil and kerosene, on their bottoms respectively, said oils of the seventh to ninth separators being drained to their tanks by way of associated cooled oil lines;

fourth to sixth freezing condensers connected to each other and adapted for condensing and liquefying the remaining gases that fail to be liquified in said seventh to ninth separators, said fourth condenser being connected to the bottom of said ninth separator through a third gas pipe and a third vacuum pipe, the condensed oil of the fourth to sixth condensers each being drained to to a respectively associated tank;

a gas compressor connected to said sixth condenser through a vacuum pump and adapted for compressing the remaining gases that fail to be liquified in said fourth to sixth condensers;

a gas cooler connected to said gas compressor and adapted for liquefying the compressed gas of the gas compressor, the liquefied gas of the gas cooler in turn being kept in the liquefied gas reservoir; and a back fire proof device connected to the gas cooler and adapted for burning out terminal gas that fail to be liquified by the gas cooler.

The present invention also provides a high-vacuum oil refinery process comprising the steps of:

preheating crude oil by a heat exchanger, said crude oil being supplied from a first intermediate terminal to said heat exchanger when the first terminal is opened by a float valve;

heating the preheated oil with a burner of a pressure reduced thermal cracking device at high temperature of 370–600° C. while letting the preheated crude oil flow in a small diameter coiling pipe of said thermal cracking device, thus to thermally crack the crude;

evaporating, expanding, cooling and accelerating the thermally cracked oil by introducing the thermally cracked oil into a larger diameter vacuum pipe and subjecting it to a vacuum condition of a first separator the moment the oil is introduced into the vacuum pipe, thus to form vapor gas and heavy oil molecules;

separating light oils from heavy oils by letting the vapor gas and the heavy oil molecules whirl down in said first separator at high velocity of 200–300 m/sec in accordance with the degree of vacuum of the first separator, centrifugally separating sulfur containing vapor gases of heavier specific gravity and heavy oil molecules from the light oils by specific gravity, and cooling and liquefying the sulfur containing vapor gases and the heavy oil molecules in the first separator, said first separator having an inner wall temperature of 260–360° C.;

producing varieties of heavy oils by collecting the liquefied sulfur containing vapor gas and heavy oil molecules in a second intermediate terminal, and processing the liquefied sulfur containing vapor gases and heavy oil molecules by centrifugally separating the heavy oils by specific and distilling super-high heavy oil and heavy oil in a high-vacuum vaporization desulfurizing device; and producing varieties of light oils by discharging vapor gases and light oil molecules of said first separator from the first separator through a gas pipe and processing the vapor gas and the light oil molecules to separate the light oils by classes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
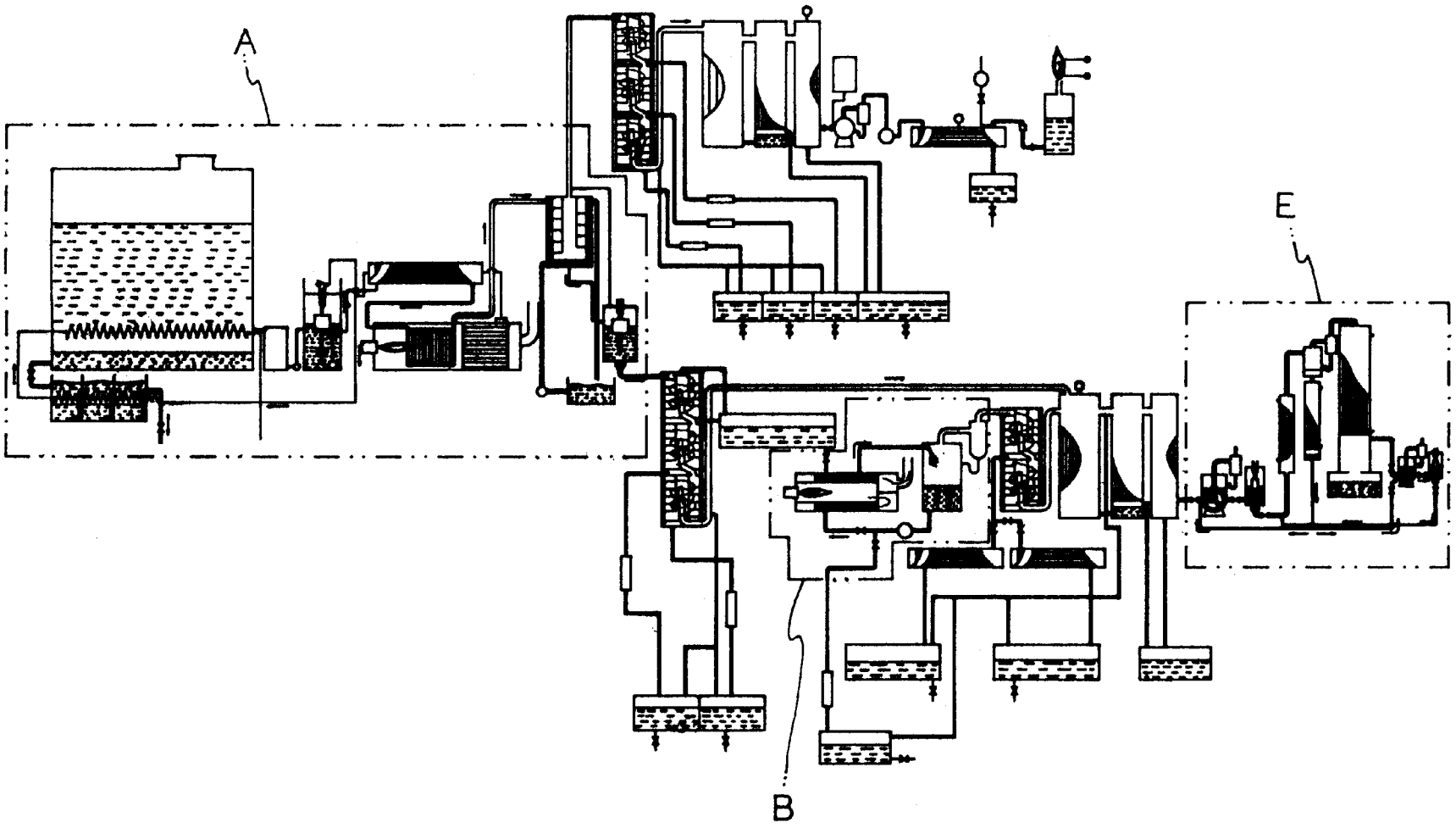
FIG. 1 is a view of total system flow showing the oil refinery process of the present invention.
Figure 2:
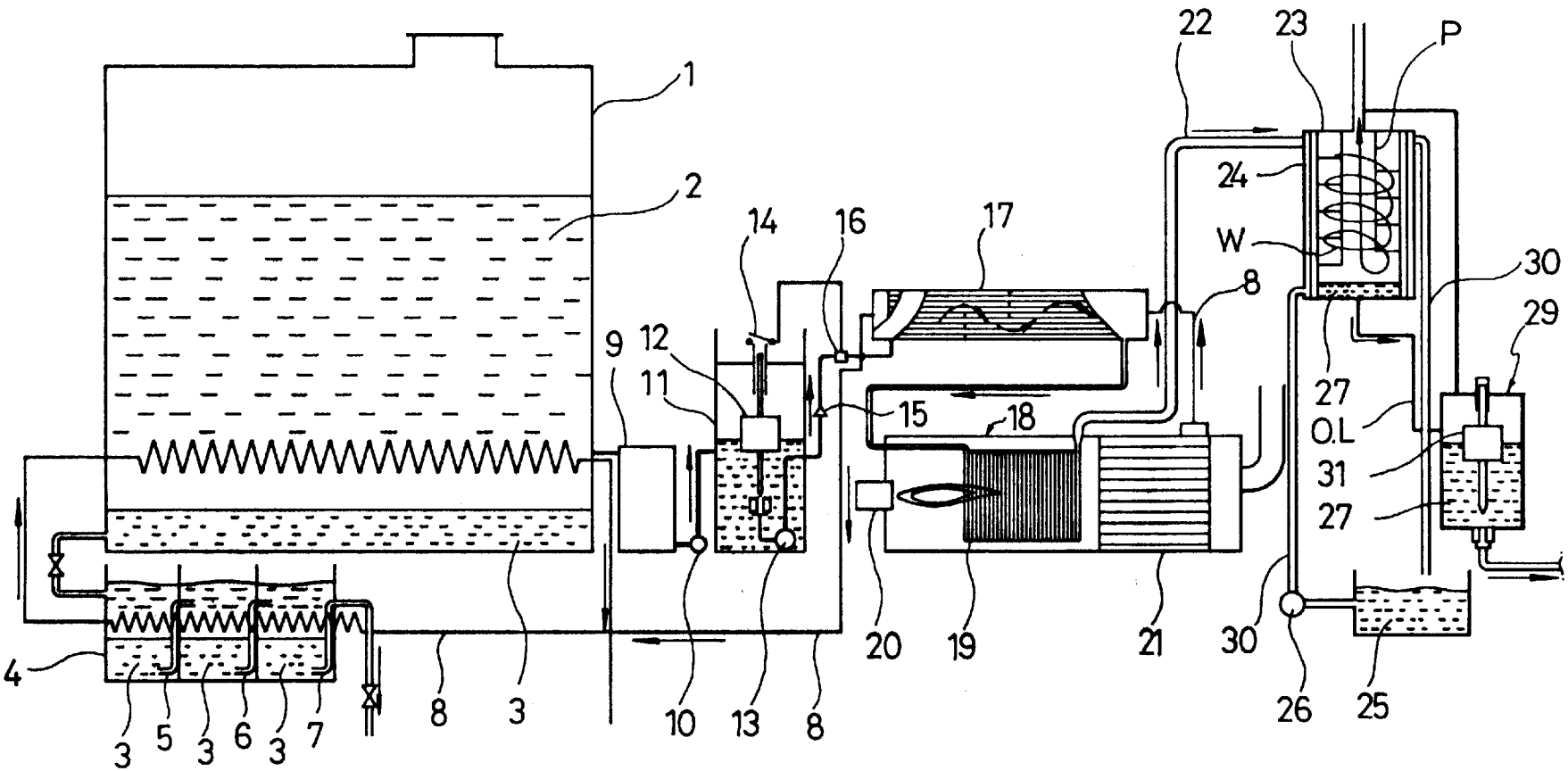
FIG. 2 is a views showing an oil separation unit of the refining system and process of the invention for separating light oils from heavy oils through pressure reduced thermal cracking device.

FIG. 1 is a view of total system flow showing the oil refining process of the present invention and FIG. 2 is a view showing an oil separating unit of the refining system and process of the invention for separating the light oils from the heavy oils through pressure reduced thermal cracking device. As shown in the drawings, the oil refining system of this invention includes the oil separating unit A for separating the light oils from the heavy oils through pressure reduced thermal cracking device. In the separating unit A, the crude or raw oil 2 of an oil/water separating reservoir 1 is pumped by the first pump 10 and filtered by oil filter 9. The filtered oil 2 is supplied to the first intermediate terminal 11. The oil 2 of the terminal 11 is, thereafter, pumped by the second pump 13 of the terminal 11 and supplied to the heat exchanger 17 wherein the oil will be preheated. The preheated oil in turn is supplied to the thermal cracking device 18. In the thermal cracking device 18, the oil passes through heating pipe (coiling pipe) 19 and, at the same time, heated by a burner 20. And the cracked or vaporized oil is, thereafter, introduced into a vacuum gas specific gravity centrifugal separator, the first separator 23, through a vacuum pipe 22 of enlarged diameter extending between the end of the coiling pipe 19 and the first separator 23. In the first separator 23, the oil is separated into heavy oils and light oils.

Figure 3:
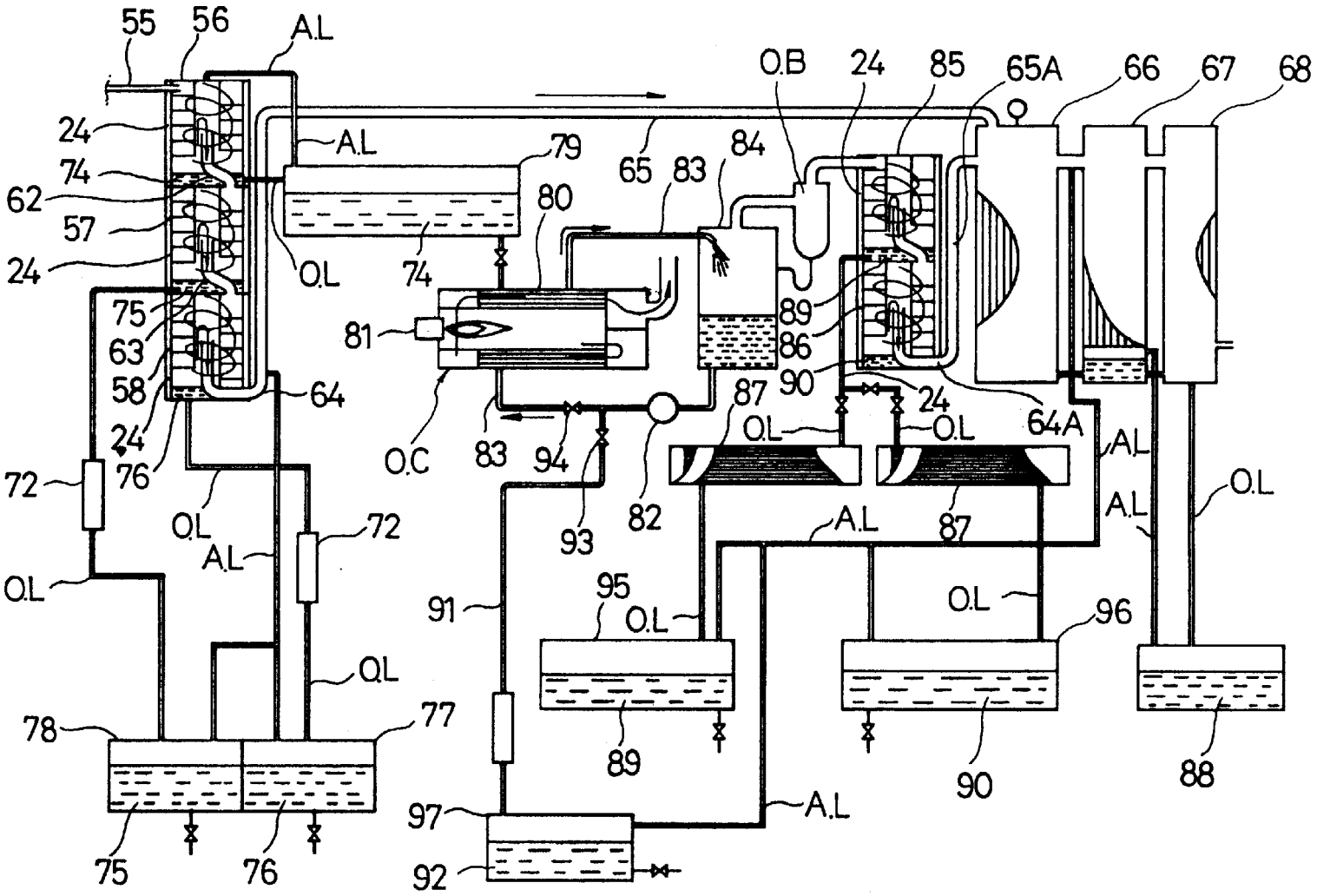
FIG. 3 is a views showing a heavy oil production unit of the refining system of the invention.

FIG. 3 is a view showing a heavy oil production unit B of the refining system of the invention. As shown in FIG. 2, the heavy oils 27 separated from the light oils by the oil separating unit A is introduced into a heavy oil intermediate terminal 29 provided with a float valve 31.

The float valve 31 selectively opens the bottom of the terminal 29 when the charged heavy oils 27 in the terminal 29 increases up to the predetermined level. The bottom of the terminal 29 is connected by pipe 55 to three high-vacuum gas specific gravity centrifugal separators, the second to fourth separators 56, 57 and 58 which separators 56 to 58, are orderly, vertically arranged and supplied with the heavy oils 27 from the terminal 29 when the float valve 31 opens the bottom of the terminal 29. In the second to fourth separators 56 to 58, high heavy oil 74, heavy oil 75 and machine oil 76 are collected on the bottoms of the separators 56 to 58 respectively.

The oils 74 and 76 of the second and fourth separators 56, 58 are directly drained to their tanks 79 and 77 respectively, while the heavy oil 75 of the third separator 57 is indirectly drained to its tank 78 by way of an oil cooler 72. The tank 79 in turn is connected to a high-vacuum vaporization desulfurizing device D so that the high heavy oil 74 of the tank 79 is supplied to the device D. The device D in turn is connected to a pair of high-vacuum gas specific gravity centrifugal separators the fifth and sixth separators 85 and 86 which are orderly, vertically arranged. The vapor gas out of the evaporator 84 whirls down in the separators 85 and 86 and liquefied into super-high heavy oil 89 and high heavy oil 90. The oils 89 and 90 are collected on the bottoms of the separators 85 and 86 respectively. The oils 89 and 90 of the separators 85, 86 in turn are supplied to their tanks 95 and 96 by way of their oil coolers 87 respectively. A first gas pipe 64 extending from the bottom of the fourth separator 58 is connected to a first vacuum pipe 65, while a second gas pipe 64A extending from the bottom of the sixth separator 86 is connected to a second vacuum pipe 65A. The first and second vacuum pipes 65 and 65A are commonly connected to first to third condensers 66, 67, and 68 so that the liquefied oils in the condensers 66, 67, 68 be supplied to the tank 88. The third condenser 68 in turn is connected to a high-vacuum pump 69 of a vacuum oil recycling and supplying unit E.

Figure 4:
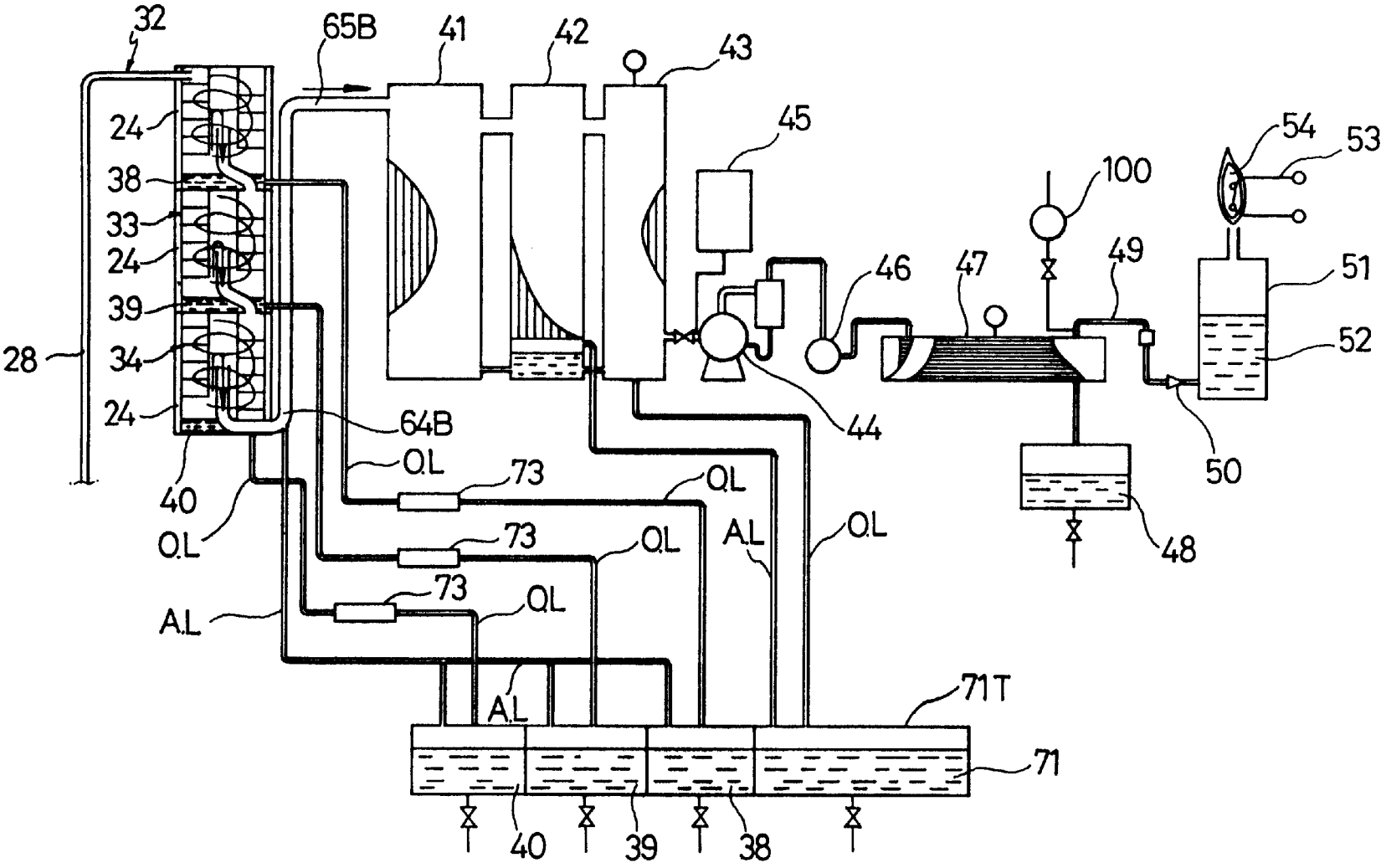
FIG. 4 is a view showing a light oil production unit of the refining system of the invention.

FIG. 4 is a views showing a light oil production unit C of the refining system of the invention. As shown in FIGS. 1 and 4, the top of the first separator 23 is connected to the top of a light oil vacuum gas specific gravity centrifugal separator 32 through a gas pipe 28. The light oil production unit C also includes two light oil vacuum gas specific gravity centrifugal separators 33 and 34 besides the above separator 32, which separators or seventh to ninth separators 32, 33, 34 are vertically arranged to be serially supplied with the light oils from the first separator 23. In the separators 32, 33, 34, light oil, gas oil and kerosene 38, 39, 40 are collected on each bottom of the separators 32, 33, 34 respectively and, thereafter, drained to their tanks 38, 39 and 40 by way of oil coolers 73 of oil lines O.L. respectively. The remaining gas which fails to be liquefied in the separators 32, 33, 34 is discharged from the bottom of the ninth separator 34 and orderly introduced into fourth to sixth condensers 41, 42 and 43 through gas outlet pipe 64B and a vacuum pipe 65B. In condensers 41, 42 and 43, the remaining gas is condensed and collected on each bottom of the condenser 41, 42 and 43. The condensed and liquefied oil 71 of the condenser 41, 42 and 43 in turn is drained to the tank 71T through oil lines O.L.

Turning to FIG. 2, the first intermediate terminal 11 of the oil separating unit A is provided with a float valve 12 which is vertically movable in accordance with level of the crude or raw oil 2 charged in the terminal 11. The vertically movable float valve 12 operates a level switch 14 and in turn operates a solenoid valve 16. The solenoid valve 16 in turn operates the second pump 13 so that the oil 2 of the terminal 11 can be supplied to the heat exchanger 17 in accordance with pumping operation of the pump 13. The heat exchanger 17 in turn is connected to the relatively small diameter coiling pipe 19 of the pressure reduced thermal cracking device 18. The coiling pipe 19 in turn is connected to the top of the first separator 23 through the relatively larger diameter vacuum pipe 22. The thermal cracking device 18 also includes the burner 20 and a boiler 21, which burner 20 and boiler 21 are placed in opposed ends of the device 18. In the device 18, the burner 20 is adapted for heating the coiling pipe 19. A steam pipe 8 extends from the boiler 21 and orderly passes through the heat exchanger 17, and oil/water specific gravity separator 4 and the oil/water separating reservoir 1 such that the steam out of the boiler 21 orderly exchanges the heat with oil in the heat exchanger 17, in the separator 4 and in the reservoir 1.

Figure 6:
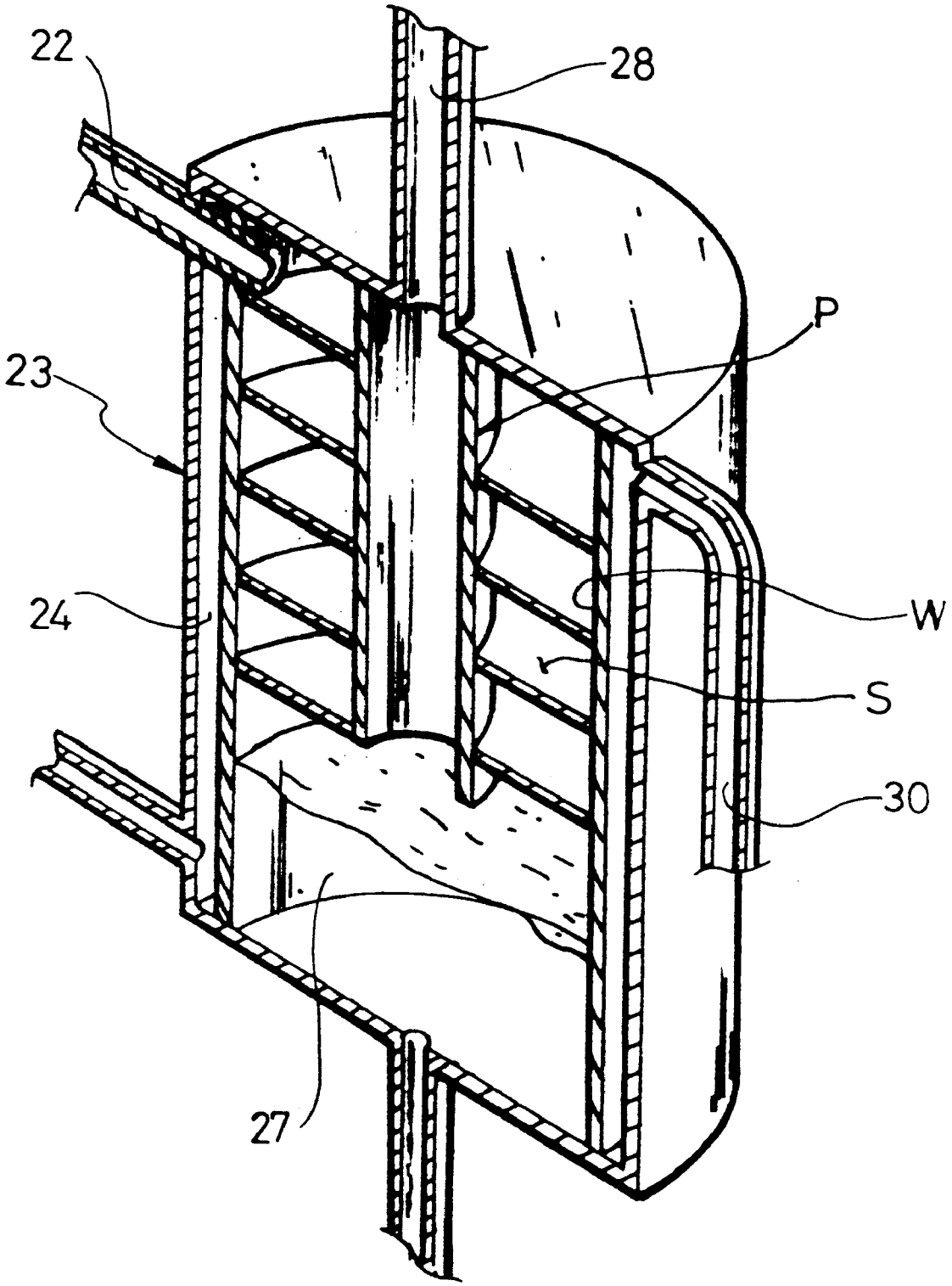
FIG. 6 is a sectional perspective view of a vacuum gas specific gravity centrifugal separator of the oil separating unit of the refining system of the invention.

As shown in FIG. 6, the first separator 23 for centrifugally separating the crude or raw oil 2 into heavy oils and light oils by specific gravity is surrounded by cooling water chamber 24. Referring now to FIG. 2, in order to let the cooling water 25 circulate in the chamber 24, the cooling water 25 of a cooling water reservoir is pumped up by a cooling water pump 26 and flows in a cooling water circulation pipe 30. Referring again to FIG. 6, a filler W is placed in the first separator 23 such that a cylindrical space is formed between the filler W. A cylinder P is vertically placed in the space between the filler W.

The top of the cylinder P is connected to the top of the seventh separator 32 of the light oil production unit C through the gas pipe 28. In the top of the first separator 23, the vacuum pipe 22 penetrates the cooling water chamber 24 as well as the filler W so that the pipe 22 is connected to the first separator 23. A spiral plate S is placed about the cylinder P of the separator 23 so that a vertically arranged spiral passage is formed between the inner wall of the first separator 23 and the outer wall of the cylinder P. The spiral passage communicates with the bottom of the cylinder P and in turn communicates with the gas pipe 28 through the cylinder P.

In the oil refining system of the invention, the second to fourth separators 56, 57 and 58 of FIG. 3 for separating the heavy oils out of the intermediate terminal 29 into varieties of heavy oils may comprise at least two separators which are vertically arranged and connected to each other in series. Of course, it should be understood that the separators 56, 57 and 58 may be arranged in parallel in case of necessity. Each of the separators 56, 57 and 58 is provided with a cooling water chamber 24 surrounding each separator 56, 57, 58. Each separator 56, 57, 58 also includes filler W and cylinder P. The filler W is provided in each separator 56, 57, 58 while the cylinder P is vertically placed in the same manner as described for the first separator 23. A spiral plate S is placed about the cylinder P so that a vertically arranged spiral passage is formed between the inner wall of each separator 56, 57, 58 and the outer wall of the cylinder P. The spiral passage of each separator 56, 57, 58 communicates with the top of a lower separator through a gas pipe and in turn is connected to the condensers 66, 67, 68 through the gas pipe 64. In the present invention, the seventh to ninth separator 32, 33, 34 of FIG. 4 for separating the light oils suplied from the first separator 23 and the fifth and sixth separator 85, 86 for separating the super-high heavy oil from the high heavy oil are constructed in the same manner as described for the second to fourth separator 56, 57, 58. However in the drawings, the gas pipe for connecting the separators 32 to 34 and to the condensers 41 to 43 is represented by 64, 65 B, while the gas pipe for connecting the separators 85 and 86 to the condensers 66 to 68 is represented by 64, 65 A.

In the high-vacuum vaporization desulfurizing device D of FIG. 3, a heat exchanging exhaust pipe is surrounded by an oil chamber O.C. The oil 74 in the chamber O.C. is heated by a burner 81 provided in an end of the oil chamber O.C. and supplied to an evaporator 84 through a circulation pipe 83. The circulation pipe 83, extending from the bottom of the evaporator 84, is provided with a pump 82 and in turn extends to the oil chamber O.C. This pipe 83 includes a valve 94 for controlling oil recirculation between the evaporator 84 and the oil chamber O.C. A sludge drain pipe 91 is branched from the circulation pipe 83 between the pump 82 and the valve 94, and extends to a sludge tank 97. The sludge drain pipe 91 is provided with a valve 93 for controlling drain of sludge oil 92. Meanwhile, the top of the evaporator 84 is connected to the top of the fifth separator 85 by way of overflow preventing means O.B. so that the vapor gas of the evapoator 84 is introduced into the separator 85 by way of the means O.B.

Figure 5:
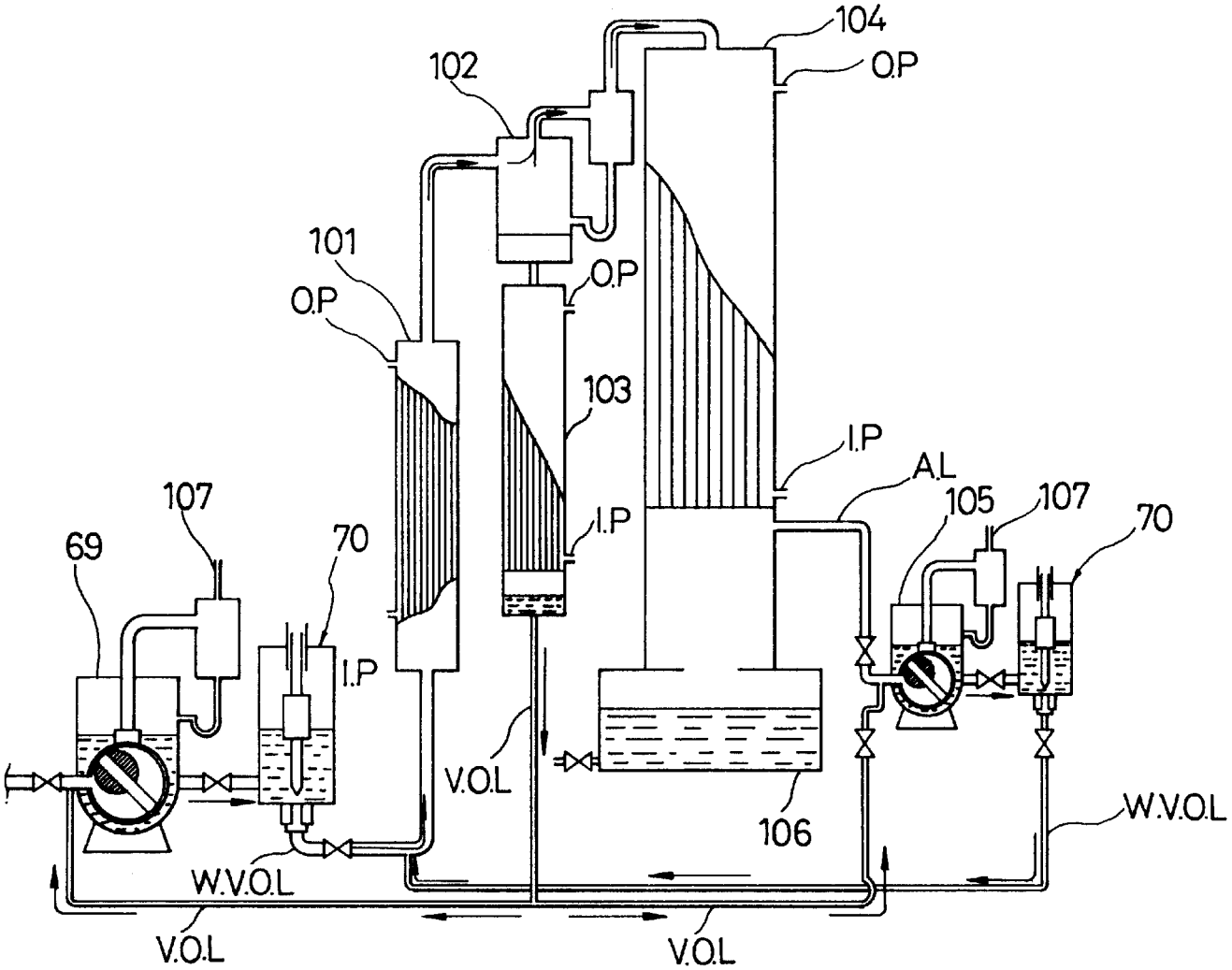
FIG. 5 is a view showing an vacuum oil recycling and supplying unit of the vacuum system of the invention.

On the other hand, the vacuum oil recycling and supplying unit E of FIG. 5 and a vacuum oil recycling and supplying unit 45 of the light oil production unit C have the same construction and the construction of the unit E of FIG. 5, for example, will be described hereinbelow.

In the vacuum oil recycling and supplying unit E adapted for reproduction of waste vacuum oil and connected to the bottom of the condenser 68, the remaining gas that failed to be condensed in the condenser 68 is pumped by a high-vacuum pump 69 and supplied to a vacuum-pump exhaust port 107. The waste vacuum oil of the high-vacuum pump 69 is supplied to a waste vacuum oil intermediate terminal or a third terminal 70 provided with a float valve.

The float valve selectively opens the bottom of the terminal 70 when the level of the vacuum oil charged in the terminal 70 is not lower than a predetermined level. When the terminal 70 is opened, the vacuum oil of the terminal 70 is orderly supplied to an oil heater 101 and to an evaporator 102. In the evaporator 102, the vacuum oil is subjected to vaporization so that moisture and volatile components of the waste vacuum oil are vaporized and removed from the vacuum oil. Therefore, the waste vacuum oil is reproduced. The reproduced vacuum oil in turn is supplied to an oil cooler 103. The vacuum oil of the cooler 103 is, thereafter, supplied to the high-vacuum pump 69 and to an auxiliary vacuum pump 105 through a vacuum oil line V.O.L. Meanwhile, the vapor gas of the evaporator 102 is introduced into a condenser 104 by way of overflow preventing means O.B. so that the vapor gas is condensed and liquefied in the condenser 104. A vacuum line A.L. extends between the condenser 104 and the auxiliary vacuum pump 105, which pump 105 is provided with an exhaust port 107 in the same manner as described for the pump 69. The pump 105 is connected to the waste vacuum oil intermediate terminal 70. When the terminasl 70 is opened by its float valve, the waste vacuum oil of the terminal 70 is introduced into the oil heater 101 through a waste vacuum oil line W.V.O.L and in turn introduced into the evaporator 102 and into the cooler 103, thus to be reproduced by the unit E and to recirculate in the unit E.

Hereinbelow, the oil refining process using the above oil refining systems will be described.

In the oil separating unit A of FIG. 2, the crude or the raw oil 2 of the oil/water separating reservoir 1 is supplied to the first intermediate terminal 11. When the float valve 12 opens the terminal 11, the oil 2 is supplied to the heat exchanger 17 so as to be preheated by the heat exchanger 17. The preheated oil 2 in turn passes through the coiling pipe 19 of the pressure reduced thermal cracking device 18. In the thermal cracking device 18, the oil is heated by the burner 20 at the temperature of 370° C.–600° C., thus to be thermally cracked. The thermally cracked oil of the device 18 in turn meets with the vacuum environment of the first separator 23 the moment the oil is introduced into the relatively larger diameter vacuum pipe 22. While flowing in the pipe 22, the vacuum gas and the heavy oil molecules are evaporated, expanded, cooled and accelerated. In the first separator 23, the cracked oil gases and the heavy oil molecules whirl down at the velocity of 200–300 m/sec in accordance with the vacuum degree of the first separator 23. In the first separator 23, the sulfur gases of heavier specific gravity as well as the heavy oil molecules are centrifugally separated from the light oils by specific gravity and cooled and liquefied on the inner wall(260–360° C.) of the first separator 23 and, thereafter, collected by the heavy oil intermediate terminal 29. The heavy oils of the terminal 29 are, thereafter, subjected to the heavy oil production process of the unit B of FIG. 3. Meanwhile, the vapor gas and the light oil molecules that failed from being liquefaction in the first separator 23 are discharged from the first separator 23 through the gas pipe 28 and subjected to the light oil production process of the unit C of FIG. 4.

In order to separate the heavy oils out of the first separator 23 into varieties of heavy oils, the heavy oils of the terminal 29 are orderly introduced into the second to fourth separators 56 to 58 which are vertically arranged. In the separators 56 to 58, the heavy oils are vaporized and liquefied by steps in accordance with vaporization temparatures (320–260° C.) and degrees of vacuum (1–$10^{-4}$ Torr) of the separator 56, 57, 58 so that the sulfur contained high heavy oil 74, the heavy oil 75 and the machine oil 76 are liquefied in the second separator 56 (inner wall temparature of 320° C.), in the third separator 57 (inner wall temperature of 300° C.) and in the fourth separator 58 (inner wall temperature of 260° C.) respectively through the high-vacuum gas centrifugal separation by specific gravity. The high heavy oil 74 out of the second separator 56 is subjected to the high-vacuum vaporization desulfurizing process and, thereafter, vaporized and liquefied in the fifth and sixth separators 85 and .86. The high heavy oil 74 is, therefore, separated into the super-high heavy oil 89, having high viscosity and vaporization liquefying temperature of 330–360° C., and the high heavy oil 90, having vaporization liquefying temperature of at least 200° C. A small amount of gas molecules fail to be liquefied in the separators 85 and 86. These are combined with the gas molecules that failed to be liquefied in the fourth separator 58 are introduced into the condensers 66 to 68 of lower vapor pressure at the same time, thus to be liquefied in the condensers 66 to 68. The gas that fails to be liquefied in the condensers 66 to 68 is pumped by the high-vacuum pump 69 and exhausted to the atmosphere. The high-vacuum pump 69 performs a vacuum oil recycling and supplying circulation process for recycling the waste vacuum oil so as to generate and sustain the desired high vacuum of the refining system of this invention.

In the high-vacuum vaporization desulfurizing process, the high heavy oil 74 out of the second separator 56 is heated by the burner 81 of the heater 80 and in turn heated and vaporized in the evaporator 84 at 1–$10^{-4}$ Torr of vacuum degree and at vaporizing temperature of 300–360° C., thus to be prevent the vaporization of sulfur. The sulfur sludge oil collected on the bottom of the evaporator 84 may be either drained to the sludge tank 97 through the sludge drain line 91 or returned to the heater 80. In the vacuum oil recycling and supplying process of the high-vacuum pump, the waste vacuum oil of inferior quality resulting from mixing of the vapor gases sucked into the cylinder of the pump 69 with the exhausted vacuum oil is collected to the third intermediate terminal 70. When the float valve opens the terminal 70, the waste vacuum oil is sucked into the evaporator 102 through the waste vacuum oil line W.V.O.L due to the vacuum suction force, which was generated by pumping operation of the auxiliary vacuum pump 105. In the evaporator 102, the wasted vacuum oil is heated to 200–300° C. so that moisture and volatile components of the oil are vaporized. The vapor gas of the evaporator 102 is sucked into the condenser 104 wherein the gas will be condensed and liquefied. The gas that fails to condense in the condenser 104 is exhausted to the atmosphere by way of the auxiliary vacuum pump 105. The recycled vacuum oil collected in the bottom of the evaporator 102 is discharged into the oil cooler 103 and in turn supplied to the high-vacuum pump 69 and to the auxiliary vacuum pump 105 through the vacuum oil supplying line. Meanwhile, the waste vacuum oil in the intermediate terminal 70, which terminal 70 is connected with the oil chambers of the pumps 69 and 105, circulates in the direction toward the oil heater 101 while being sucked, heated and vaporized, so that the waste vacuum oil is recycled and supplied through the same manner as described above.

In the light oil production process, the light oils of the first separator 23 are introduced into the vacuum gas specific gravity centrifugal separators the seventh to ninth separators 32, 33, 34 through the gas pipe 28. In the separators 32 to 34, the light oils are accelerated and whirl down due to 5–20 Torr of vacuum degrees and are centrifugally separated and liquefied by specific gravity, which degrees of vacuum are increased by coming closer to the separators 32 to 34 and to the vacuum pump 44, the condensers 41, 43. In the separators 32 to 34, the light oils are centrifugally separated and liquefied by specific gravity in such a manner that the light oil 38, the gas oil 39 and the kerosene 40 are liquefied in the seventh separator 32 (inner wall temperature of about 200° C.), in the eighth separator 33 (inner wall temperature of about 30° C.) respectively. The oils 38 to 40 in turn are cooled by their coolers and kept in their tanks. The volatile components of the light oils that fail to liquefy in the separators 32 to 34 are introduced into the freezing condensers 41 to 43 of low temperature of −20° C. and higher degree of vacuum, thus to be liquefied. The remaining gas, for example, LPG and methane gas, that fail to liquefy in the condensers 41 to 43 is compressed by a gas compressor 46 and, thereafter, liquefied in a gas cooler 47 of −40° C. and kept in a liquefied gas reservoir 48. Meanwhile, the terminal gas that fail to liquefy in the gas cooler 47 passes through a regulator 49 and a check valve 50 and, thereafter, passes through the water 52 in a back fire proof device. The terminal gas, after passing through the water 52, is ignited by an igniter 53 provided in an end of the back fire proof device, thus to be burnt.

In the drawings, the reference numeral 3 denotes the water separated from the waste oil by specific gravity, the numerals 5, 6 and 7 denotes water pipes respectively, the numeral 15 denotes a check valve, the numerals 62 and 63 denote gas pipes, the numeral 92 denotes the sludge oil, the numerals 93 and 94 denote the control valves, the numeral 100 denotes a vacuum pump and the numeral 106 denotes a condenser receiver tank.

In the oil refining process of the above oil refinery system the crude or the raw oil 2 of the reservoir 1, which reservoir 1 separates the oil 2 from the water 3 by specific gravity, when needed passes through the filter 9. The filter 9 filters off impurities of the oil 2. The filtered oil 2 in turn is sucked into the suction pump 10 and supplied to the oil intermediate terminal 11. When the level of the oil 2 charged in the terminal 11 exceeds the predetermined level, the float valve 12 is lifted up and opens the suction port of the pump 13 of the terminal 11 and, thereafter, pushes up the level switch 14, thus to turn on the switch 14.

At the same time, the solenoid valve 16 is opened, thus to operate the pump 13. Therefore, the oil 2 is supplied to the heat exchanger 17 through the pipe and in turn supplied to the coiling pipe 19 of the pressure reduced thermal cracking device 18. While passing through the heat exchanger 17, the oil 2 exchanges the heat with the steam of the steam pipe 8 and preheated to a predetermined temperature, which steam was generated by the boiler 21 of the thermal cracking device 18 and reversely flows in the steam pipe 8 toward the oil/water separator 4. The preheated oil in turn flows in the coiling pipe 19 of the thermal cracking device 18. While flowing in the coiling pipe 19, the oil is heated to about 370–600° C. by the burner 20 of the device 18, thus to be thermally cracked and vaporized. The moment the thermally cracked oil advances into the pipe 22, the oil is, evaporated, expanded and accelerated due to the suddenly enlarged diameter of the pipe 22 and due to the vacuum environment of the first separator 23 communicating with the pipe 22. In the first separator 23, the vapor gas and the heavy oil molecules whirl down in the spiral passage of the first separator 23 at a high velocity (200–300 m/sec) in accordance with the vacuum degree of the first separator 23.

Therefore, the sulfur vapor gas and heavy oil molecules of heavier specific gravity are centrifugally separated by specific gravity on the inner wall of the cooling water chamber 24 of the first separator 23. The heavier gas molecules are cooled and liquefied by the lower temperature of inner wall (260–360° C.) of the cooling water chamber 24 of the first separator 23, thus to become the heavy oils 27, which oils 27 will be collected by the intermediate terminal 29. In the first separator 23, the temperature controlling filler W is placed between the inner wall of the cooling water chamber 24 and the cylinder P, thus to keep the liquefying temperature of the heavy oils within the range from 260° C. to 360° C.

The light gas molecules and the light oil particles that fail to liquefy in the first separator 23 are introduced into the seventh separator 32 of the light oil production unit C through the gas pipe 28. In the first separator 23, the oil, after being processed by the thermal cracking device 18, is separated into light oils 38 and heavy oils 27 as described above. The quantity of the light oils 38 and the heavy oils 27 is influenced by the heating temperature of the burner 20 of the thermal cracking device 18. Of course, it should be understood that the heavy oils 27 collected by the intermediate terminal 29 may be again processed through the pressure reduced thermal cracking process of the device 18 and heated and thermally cracked again, thus to be converted into light oils.

In this case, the production ratio of the light oils may be increased.

The oil and water of the oil/water separator 4 are heated to an appropriate temperature by the waste heat of the steam flowing in the steam pipe 8 extending from the boiler 21 of the thermal cracking device 18. As a result of heating by the steam, the oil and water are separated from each other by specific gravity.

Meanwhile, the light oil gases introduced in to the top of the seventh separator 32 of the light oil production unit C are accelerated and whirl down in the separators 32 to 34 due to degrees of vacuum at 5–20 Torr and are centrifugally separated and liquefied by specific gravity, which degrees of vacuum may be increased while coming closer to the separators 32 to 34 and to the vacuum pump 44, the condensers 41, 43.

In the separators 32 to 34, the light oils are centrifugally separated and liquefied by specific gravity in such a manner that the light oil 38, the gas oil 39 and kerosene 40 are liquefied in the seventh separator 32 (inner wall temperature of about 200° C.), in the eighth separator 33 (inner wall temperature of about 160° C.) and in the ninth separator 34 (inner wall temperature of about 30° C.) respectively. The oils 38 to 40 in turn are cooled by their oil coolers 73 and kept in their tanks. The volatile components 71 of the light oils that fail to liquefy in the separators 32 to 34 are introduced into the freezing condensers 41 to 43 of −20° C. and higher degree of vacuum, thus to be liquefied. The remaining gas, for example, LPG and methane gas, which fail to liquefy in the condensers 41 to 43 is compressed by the gas compressor 46 and, thereafter, liquefied in the gas cooler 47 of −40° C. and kept in the liquefied gas reservoir 48. Meanwhile, the terminal gas that fails to liquefy in the gas cooler 47 passes through the regulator 49 and the check valve 50 and, thereafter, passes through the water 52 in the back fire proof device 51. The terminal gas, after passing through the water 52, is ignited by the ignitor 53 provided in an end of the back fire proof device 51, thus to be burnt as a flame 54. In this case, the water 52 of the back fire proof device 51 is adapted for blocking the gas from the flame 54 of the back fire proof device 51, which gas is introduced into the device 51 from the gas cooler 47 by way of the check valve 50. By use of the water 52, the possibility of back fire is removed. The vacuum pump 100 makes the vacuum condition of the gas cooler 47. The operation of the vacuum oil recycling and supplying unit 45 connected to the vacuum pump 44 of the light oil production unit C will be descirbed in the following description for the heavy oil production unit B.

The sulfur containing heavy oil, which was liquefied along with the sulfur gas in the first separator 23, is introduced into the intermediate terminal 29. When the level of the heavy oils exceeds the predetermined level in the terminal 29, the float valve 31 of the terminal 29 is lifted up so that the heavy oil line 55 extending from the terminal 29 to the first separator 56 is opened. Therefore, the heavy oils 27 of the terminal 29 are supplied to the first to third separators 56 to 58. In the second to fourth separators 56 to 58, the heavy oils 27 are centrifugally separated by specific gravity and liquefied by classes in accordance with the liquefying temperatures (320–260° C.) and with degrees of vacuum ($1–10^{-4}$ Torr) and kept in the tanks respectively. That is, the sulfur high heavy oil 74 is liquefied in the second separator 56 (inner wall temperature of about 320° C.), the heavy oil 75 which has shorter carbon chains and lower liquefying temperature than those of the high heavy oil 74 is liquefied in the third separator 57 (inner wall temperature of about 300° C.) and the machine oil 76 is liquefied in the fourth separator 587 (inner wall temperature of about 260° C.). The oils 74, 75 and 76 are cooled in the oil coolers 72 and kept in their tanks 79, 78 and 77.

Meanwhile, the high heavy oil 74 of the tank 79 in turn is introduced into the high heavy oil heater 80 and circulates through the circulation pipe 83 by the pumping force of the pump 82. At this time, the high heavy oil 74 is heated at 300–360° C. by the burner 81 of the heater 80 while keeping the degree of vacuum of the evaporator 84 at $1–10^{-4}$ Torr, thus to be vaporized under the high vacuum condition and at the temperature of 300–360° C. Therefore, the high-vacuum distillation for high heavy oil, except for the sulfur component of the high heavy oil 74, is carried out. As a result of the high-vacuum distillation, the super-high heavy oil 89 of high viscosity is liquefied in the forth separator 85 at vaporization-liquefying temperature of 330–360° C., and the high heavy oil 90 is liquefied in the sixth separator 86 at vaporization liquefying temperature of at least 200° C. The oils 89 and 90 in turn are cooled in the oil coolers 87 and kept in their tanks 95 and 96. The sludge oil 92 of the evaporator 84, which oil 92 resulted from vaporization and concentration, is drained to the sludge tank 97 through the drain line 91 under the control of the drain valve and subjected to an additional sludge treatment process.

The gas molecules that fail to liquefy in the sixth separator 86 are introduced into and liquefied by the condensers 66 to 68 where the vapor pressure is lower and kept in the condenser receiver tank 88. The remaining gas failed from being liquefaction in the condensers 66 to 68 is exhausted to the atmosphere through the exhaust port 107 of the high-vacuum pump 69.

Hereinbelow, the vacuum oil sealing type hyper curved cylinder high-vacuum pump 69 of the solid vane (no spring) rotation by eccentric rotor for achieving desired high vacuum of this high-vacuum oil refinery system and the vacuum oil recycling and supplying unit E for sustaining the high vacuum and for achieving the high-vacuum oil refining process of the invention will be described.

The high-vacuum pump 69 is provided in the terminal part of the heavy oil production unit B along with the vacuum oil recycling and supplying unit E. Due to the high-vacuum distillation process of the oil refining system of the invention, vapor gases such as moisture, kerosene, gas oil and gasoline are sucked into the cylinder of the pump 69 rotating in the cylinder along with the vacuum oil due to the rotation of the vane. Therefore, the vapor gases are mixed with the vacuum oil and deteriorate the original quality of the vacuum oil used for sealing the gap between the vane and the cylinder, thereby breaking the sealing effect of the vacuum oil and causing sudden loss of the degree produced by vacuum of the pump 69.

In order to remove the above problem, high pressure vapor components, such as gasoline, moisture, kerosene and gas oil, which become mixed in the vacuum oil should be treated to be removed from the waste vacuum oil.

In order to remove volatile components and moisture from the wasted vacuum oil and to restore the original quality of the vacuum oil, the waste vacuum oil whose quality was deteriorated due to mixing with the moisture and with the volatile components is introduced into the waste vacuum oil intermediate terminal 70 provided with the float valve.

When the float valve opens the terminal 70, the waste vacuum oil of the terminal 70 flows to the evaporator 102 through the waste vacuum oil line W.V.O.L due to the vacuum suction force of the oil heater 101, which suction force was generated by the pumping operation of the vacuum pump 105. While flowing to the evaporator 102, the waste vacuum oil may be heated to 200–300° C. by steam heat or other heat exchanging means. The heated waste vacuum oil in turn is sucked into the evaporator 102. At this time, the moisture and the volatile components having higher vapor pressure than that of the vacuum oil are vaporized and sucked into the condenser 104 of higher degree of vacuum than that of the evaporator 102, thus to be liquefied in the condenser 104. And the remaining gas that fails to liquefy in the condenser 104 is exhausted to the atmosphere through the vacuum pump 105 and the exhaust port 107.

On the other hand, the reproduced vacuum oil from which the moisture and the volatile components are vaporized and removed is collected in the bottom of the evaporator 102 and in turn flows down through the oil cooler 103, thus to be cooled. The reproduced and cooled vacuum oil in turn is supplied to the high-vacuum pump 69 and to the auxiliary vacuum pump 105 through the vacuum oil supply line V.O.L. The waste vacuum oil of the terminal 70 is sucked and circulates toward the oil heater 101 through the waste vacuum oil line W.V.O.L. and processed by the above vacuum oil reproduction process. Therefore, it is possible to generate and keep the desired high vacuum of the high-vacuum pump 69.

As the above oil refinery system and process of the invention are based on repeated experiments and practical tests, there is no problem in adapting the system and process to commercial plant as a practical service engineering. Of course, the other pressure reducing means such as high speed ejectors maybe adapted when necessity. The automatic valve control system may also be adapted when needed.

Although the preferred embodiments of the present invention have been disclosed for illustrative purposes, those skilled in the art will appreciate that various modifications, additions and substitutions are possible, without departing from the scope and the spirit of the invention as disclosed in the accompanying claims.

The experimental results are shown in the following Tables 1, 2, using the system and the process of the present invention.

The experimental oils are the recycled engine oil from wasted oil in Table 1, and in Table 2, respectively.

TABLE 1

| Experimental Items | | Experimental Results | Experimental Methods |
|---|---|---|---|
| Ignition Point (COC, °C.) | | 226 | KSM 2010–93 |
| Kimenatic Viscosity (CSt) | 100° C. | 5.468 | KSM 2014–90 |
| | 40° C. | 32.47 | |
| Viscosity coefficient | | 103 | |
| Fluid Point | | −15.0 | KSM 2016–90 |
| Oxidation stability | Viscosity | 110 | KSM 2021–90 |
| | TAN Increasements (mg KOH/g) | 0.51 | |
| | Lacquer Ability | NO | |
| Frictional coefficient | | 0.108 | IP 332 |
| Appearance Viscosity at Low Temperature (−20° C., CP) | | 2,210 | KSM 2121–90 |

TABLE 2

| Experimental Items | | Experimental Results | | Experimental Methods |
|---|---|---|---|---|
| | | High Vacuum 1 | High Vacuum 2 | |
| Kinematic Viscosity (50° C., cSt) | | 17.96 | 16.34 | KSM 2014–90 |
| Sulfur Components (X-ray, %) | | 0.23 | 0.23 | KSM 2027–92 |
| Calcium Oxidation Components (%) | | Below 0.01 | Below 0.01 | KSM 2044–90 |
| Residual Carbon (%) | | 0.02 | 0.02 | KSM 2017–91 |
| Water Components (%) | | Below 0.05 | Below 0.05 | KSM 2058–90 |
| Specific Gravity (15/4° C.) | | 0.8633 | 0.8655 | KSM 2002–91 |
| Water/Deposits | | Only Traces | Only Traces | KSM 2118–92 |
| Metal Components (PPm) | Pb | Below 1 | Below 1 | Arc-Stark (M.O.A.) |
| | Cd | Below 1 | Below 1 | |
| | Cr | Below 1 | Below 1 | |

What is claimed is:

1. A high-vacuum oil refinery system comprising:

an oil separating unit for separating light oils from heavy oils by a pressure reduced thermal cracking process, said oil separating unit including:

an oil/water separating reservoir;

a first intermediate terminal connected to said reservoir through both a first pump and an oil filter, said first terminal being provided with a second pump for pumping the crude or the raw oil of the first terminal;

a heat exchanger for preheating the oil out of said first terminal, said heat exchanger being connected to said first terminal;

a pressure reduced thermal cracking device for thermally cracking the preheated crude or heavy oil, said device being connected to said heat exchanger; and a first vacuum gas specific gravity centrifugal, separator connected to said thermal cracking device through a vacuum pipe, said first separator centrifugally separating the light oils from the heavy oils by specific gravity;

a heavy oil production unit connected to said oil separating unit and adapted for separating the heavy oils and producing varieties of heavy oils by classes, said heavy oil production unit including:

a second, heavy oil intermediate, terminal connected to said first separator of the oil separating unit and adapted for temporarily keeping the heavy oils out of the first separator, said second terminal having a float valve so that the second terminal is selectively opened when the level of the heavy oils in the second terminal exceeds a predetermined level;

second to fourth, high-vacuum gas specific gravity centrifugal, separators for separating the heavy oils by classes, each having a tank associated therewith, said second to fourth separators being orderly connected to the bottom of the second terminal and collecting the varieties of heavy oils, that is, high heavy oil, heavy oil and machine oil, on their bottoms respectively, said oils collected by the second and fourth separators being directly drained to their associated tanks respectively, while said heavy oil collected by the third separator being indirectly drained to its associated tank by way of an oil cooler;

a high-vacuum vaporization desulfurizing device connected to said high heavy oil tank and adapted for desulfurizing the high heavy oil by high vacuum vaporization;

fifth and sixth, high-vacuum gas specific gravity centrifugal, separators orderly connected to said desulfurizing device, each having a tank associated therewith, said fifth and sixth separators being adapted for liquefying vapor gas out of said desulfurizing device into super-high heavy oil and high heavy oil in accordance with degrees of vacuum and liquefying temperatures of the fifth and sixth separators and supplying the super-high heavy oil and the high heavy oil to their associated tanks by way of oil coolers; and first to third condensers connected to each other and adapted for condensing and liquefying the remaining gases that fail to be liquified in said fourth and sixth separators, said first condenser being commonly connected to the fourth separator through both a first gas pipe and a first vacuum pipe and to the sixth separator through both a second gas pipe and a second vacuum pipe, the oils condensed and liquefied by said first to third condensers being kept in their tank, and the bottom of said third condenser being connected to high-vacuum pump which utilizes vacuum oil;

a vacuum oil recycling and supplying unit for reproducing the vacuum oil used by said high-vacuum pump said vacuum oil recycling and supplying unit being connected to said third condenser of the heavy oil production unit through said high-vacuum pump;

a light oil production unit connected to the top of the first separator and adapted for separating the light oils and producing varieties of light oils by classes, said light oil production unit including:

seventh to ninth, light oil vacuum gas specific gravity centrifugal, separators orderly connected to said first separator of the oil separating unit, each having a tank associated therewith, said seventh to ninth separators being adapted for liquefying and collecting said varieties of light oils, that is, light oil, gas oil and kerosene, on their bottoms respectively, said oils of the seventh to ninth separators being drained to their tanks by way of associated cooled oil lines;

fourth to sixth freezing condensers connected to each other and adapted for condensing and liquefying the remaining gases that fail to be liquified in said seventh to ninth separators, said fourth condenser being connected to the bottom of said ninth separator through a third gas pipe and a third vacuum pipe, the condensed oil of the fourth to sixth condensers each being drained to to a respectively associated tank;

a gas compressor connected to said sixth condenser through a vacuum pump and adapted for compressing the remaining gases that fail to be liquified in said fourth to sixth condensers;

a gas cooler connected to said gas compressor and adapted for liquefying the compressed gas of the gas compressor, the liquefied gas of the gas cooler in turn being kept in the liquefied gas reservoir; and a back fire proof device connected to the gas cooler and adapted for burning out terminal gas that fails to be liquified by the gas cooler.

2. The high-vacuum oil refinery system according to claim 1, wherein the first terminal of the oil separating unit further includes:

a float valve vertically movable in accordance with level of the oil charged in the first terminal;

a level switch operated by said vertically movable float valve; and a solenoid valve operated by said level switch and in turn operating the second pump, whereby the oil of the first terminal is supplied to the heat exchanger in accordance with pumping operation of the second pump.

3. The high-vacuum oil refinery system according to claim 1, wherein the pressure reduced thermal cracking device further includes:

a small diameter coiling pipe connected to said heat exchanger at one end thereof and to the top of said first separator at the other end thereof through the pipe of larger diameter;

a burner and a boiler placed in opposed ends of the thermal cracking device, said burner being adapted for heating the coiling pipe; and a steam pipe extending from said boiler and orderly passing through said heat exchanger, an oil/water specific gravity separator and said oil/water separating reservoir so that the steam generated by the boiler, orderly exchanges heat with the oil in the heat exchanger in the oil/water specific gravity separator and in the oil/water separating reservoir respectively.

4. The high-vacuum oil refinery system according to claim 1, wherein said first separator includes:

a cooling water chamber surrounding the first separator and adapted for cooling the first separator by cooling water pumped up by a cooling water pump and circulating through a cooling water circulation pipe;

a filler provided in the first separator such that a cylindrical space is formed inner side of the filler;

a cylinder placed in the space formed inner side of the filler, the top of said cylinder being connected to the top of said seventh separator of the light oil production unit through a gas pipe;

the vacuum pipe penetrating the cooling water chamber as well as the filler so that the vacuum pipe is connected to the top of the first separator; and a spiral plate placed about the cylinder so that a vertically arranged spiral passage is formed between the inner wall of said first separator and the outer wall of said cylinder, said spiral passage communicating with the bottom of said cylinder and in turn communicating with the gas pipe through the cylinder.

5. The high-vacuum oil refinery system according to claim 1, wherein each set of the second to fourth separators, the fifth and sixth separators and the seventh to ninth separators comprises at least two separators vertically arranged and connected to each other, and each of said separators including:

a cooling water chamber surrounding each separator;

a temperature controlling filler placed in each separator such that a cylindrical space is formed inner side of the filler;

a cylinder placed in the space formed inner side of the filler; and a spiral plate placed about the cylinder so that a vertically arranged spiral passage is formed about the cylinder, said spiral passage communicating with the top of a lower separator through a gas pipe.

6. The high-vacuum oil refinery system according to claim 1, wherein the high-vacuum vaporization desulfurizing unit includes:

an exhaust pipe;

an oil chamber surrounding the exhaust pipe, the oil in said oil chamber being heated by a burner and pumped by an oil circulation pump and supplied to the evaporator through a circulation pipe;

the circulation pipe having both a pump and a circulation valve for controlling an oil recirculation between said evaporator and said oil chamber;

a sludge drain pipe branched from said circulation pipe between said pump and said circulation valve and extending to a sludge tank, said sludge drain pipe having a sludge drain valve so that sulfur sludge oil of the evaporator is either drained to the sludge tank through the sludge drain pipe or returned to the oil chamber; and overflow preventing means provided in a pipe extending between the top of said fifth separator so that the super-high heavy oil vaporized and distilled by said vaporizer is introduced into the fifth separator by way of the overflow preventing means.

7. The high-vacuum oil refinery system according to claim 1, wherein the vacuum oil recycling and supplying unit includes:

the high-vacuum pump adapted for pumping the remaining gas that failed to be condensed in the first to third condensers and for supplying the still remaining gas to a vacuum-pump exhaust port;

a third waste vacuum oil intermediate, terminal provided with a float valve and supplied with waste vacuum oil from the high-vacuum pump, said float valve selectively opening the third terminal when the level of the vacuum oil in the third terminal exceeds a predetermined level;

an oil heater and an evaporator orderly connected to the third terminal, said evaporator being adapted for vaporizing the waste vacuum oil and vaporizing and removing moisture and volatile components from the waste vacuum oil and recycling the waste vacuum oil, the so reproduced vacuum oil in turn being supplied to an oil cooler and to the high-vacuum pump, and to an auxiliary vacuum pump through a vacuum oil line;

a condenser connected to said evaporator by way of overflow preventing means and adapted for condensing and liquefying the vapor gas of the evaporator; and the auxiliary vacuum pump provided with an exhaust port and connected to said condenser through a vacuum line, said auxiliary vacuum pump being adapted for exhausting the gas that failed to be liquefied in said condenser from the exhaust port and connected to the third terminal so that the waste vacuum oil of the third terminal is introduced into the oil heater through a waste vacuum oil line so as to be reproduced by and recirculate in the vacuum oil recycling and supplying unit as the third terminal is opened by its float valve.

8. A high-vacuum oil refinery process comprising the steps of:

preheating crude oil by a heat exchanger, said crude oil being supplied from a first intermediate terminal to said heat exchanger when the first terminal is opened by a float valve;

heating the preheated oil with a burner of a pressure reduced thermal cracking device at high temperature of 370–600° C. in a small diameter coiling pipe of said thermal cracking device, thus to thermally crack the crude oil;

evaporating, expanding, cooling and accelerating the thermally cracked oil by introducing the thermally cracked oil into a larger diameter vacuum pipe and subjecting it to a vacuum condition of a first separator the moment the oil is introduced into the vacuum pipe, thus to form vapor gas and heavy oil molecules;

separating light oils from heavy oils by letting the vapor gas and the heavy oil molecules whirl down in said first separator at high velocity of 200–300 m/sec in accordance with the degree of vacuum of the first separator, centrifugally separating sulfur containing vapor gases of heavier specific gravity and heavy oil molecules from the light oils by specific gravity, and cooling and liquefying the sulfur containing vapor gases and the heavy oil molecules in the first separator, said first separator having an inner wall temperature of 260–360° C.;

producing varieties of heavy oils by collecting the liquefied sulfur containing vapor gas and heavy oil molecules in a second intermediate terminal, and processing the liquefied sulfur containing vapor gases and heavy oil molecules by centrifugally separating the heavy oils by specific gravity and distilling super-high heavy oil and heavy oil in a high-vacuum vaporization desulfurizing device; and producing varieties of light oils by discharging vapor gases and light oil molecules of said first separator from the first separator through a gas pipe and processing the vapor gas and the light oil molecules to separate the light oils by classes.

9. The high-vacuum oil refinery process according to claim 8, wherein the heavy oil producing step is carried out in such a manner that the heavy oils out of the first separator are separated into the varieties of heavy oils such that the heavy oils of the second terminal are orderly introduced into second to fourth separators and vaporized and liquefied in accordance with liquefying temperatures of 320–260° C. and degrees of vacuum of 1–10-$^{-4}$ Torr in said second to fourth separators, thus liquefying sulfur containing high heavy oil, heavy oil and machine oil by a high-vacuum gas specific gravity centrifugal separation, the second separator having an inner wall temperature of 320° C., the third separator having an inner wall temperature of 300° C. and the fourth separator having an inner wall temperature of 260° C., said high heavy oil of the second separator is subjected to a high-vacuum vaporization desulfurizing step and vaporized and liquefied in fifth and sixth separators and separated into said super-high heavy oil, having high viscosity and said high heavy oil, having a vaporization liquefying temperature of at least 200° C., gas molecules that fail to be liquefied in said fifth and sixth separators as well as gas molecules from the liquefaction of said fourth separator are introduced into a plurality of condensers of lower vapor pressure at the same time, thus to be liquefied in said condensers, and gas that fails to to be liquefied in said condensers is pumped and exhausted by a high-vacuum pump or burnt out.

10. The high-vacuum oil refinery process according to claim 9, wherein the high-vacuum vaporization desulfurizing step is carried out in such a manner that the high heavy oil out of the second separator is heated by a burner of an oil heater and in turn heated in an evaporator at the temperature of 300–360° C. under $1–10^{-4}$ Torr of vacuum condition, thus to be vaporized without vaporizing the sulfur under the condition of high vacuum, and sulfur sludge oil concentrated in the evaporator is either drained to sludge tank through a sludge drain line or returned to said oil heater.

11. The high-vacuum oil refinery process according to claim 9, wherein a vacuum oil recycling and supplying circulation step for a high-vacuum pump utilizing vacuum oil is carried out in such a manner that waste vacuum oil of inferior quality resulting from mixing of vapor which has sucked into the cylinder of said high-vacuum pump with vacuum oil is collected to a third intermediate terminal, the waste vacuum oil is sucked into an evaporator through an oil heating line due to vacuum suction force of an oil heater when a float valve opens the third terminal, said vacuum suction force being generated in said oil heater due to pumping operation of an auxiliary vacuum pump, and the waste vacuum oil is heated in the oil heater to the temperature of 200–300° C. so that moisture and volatile components of the oil are vaporized, and vapor gas of the evaporator is sucked into a vaccum oil condenser so as to be condensed and liquefied, and the gas that fails to be condensed in said vaccum oil condenser is exhausted to the atmosphere by way of the auxiliary vacuum pump, and the so reproduced vacuum oil collected in the bottom of the evaporator is discharged to an oil cooler and in turn supplied to the high-vacuum pump and to the auxiliary vacuum pump through a vacuum oil supply line, and the waste vacuum oil in the third intermediate terminal connected to oil chambers of both said high-vacuum pump and said auxiliary vacuum pump circulates in the direction toward the oil heater while being sucked, heated and vaporized, so that the waste vacuum oil is reproduced into useful vacuum oil.

12. The high-vacuum oil refinery process according to claim 8, wherein the light oil producing step is carried out in such a manner that the light oils of the first separator are introduced into vacuum gas specific gravity centrifugal separators, the seventh to ninth separators, through the gas pipe, the light oil molecules are accelerated and whirl down in the seventh to ninth separators at 5–20 Torr of vacuum degrees and are centrifugally separated by specific gravity and liquefied by said degrees of vacuum being increased in inverse proportion to the distance between the seventh to ninth separators approaching a vacuum pump and freezing condensers, the light oils are centrifugally separated and liquefied by specific gravity in the separators such that light oil, gas oil and kerosene are liquefied in the seventh separator of inner wall temperature of about 200° C., in the eighth separator of inner wall temperature of about 160° C. and in the ninth separator of inner wall temperature of about 30° C. respectively, said oils of the seventh to ninth separators in turn are cooled by coolers and kept in separate tanks connected to the respective separators, volatile components of the light oils that failed to be liquefied in the seventh to ninth separators are introduced into said freezing condensers of low temperature of −20° C. and higher degree of vacuum thus to be liquefied, remaining gas that failed to be liquefied in the freezing condensers is compressed by a gas compressor and liquefied in a gas cooler of −40° C. and kept in a liquefied gas reservoir, and terminal gas that failed to be liquefied in the gas cooler passes through a regulator and a check valve and passes through water in a back fire proof device and in turn is ignited by an ignitor of the back fire proof device, thus to be burnt.

* * * * *